United States Patent [19]

Inoue et al.

[11] 4,099,476

[45] Jul. 11, 1978

[54] REMOTE CONTROL APPARATUS FOR MARINE ENGINES

[75] Inventors: Hiroo Inoue, Amagasaki; Isao Kishimoto, Kobe, both of Japan

[73] Assignee: The Nippon Air Brake Co., Ltd., Kobe, Japan

[21] Appl. No.: 788,397

[22] Filed: Apr. 18, 1977

[30] Foreign Application Priority Data

May 12, 1976 [JP] Japan ..... 51-54751

[51] Int. Cl.[2] ..... B63H 25/24

[52] U.S. Cl. ..... 114/144 R; 60/567; 74/480 B; 74/484 R; 114/150

[58] Field of Search ..... 60/567, 581; 74/480 B, 74/483 R, 484 R, 494; 114/144, 150; 115/18 R, 18 E, 35; 180/775; 244/84

[56] References Cited

U.S. PATENT DOCUMENTS

| | | | |
|---|---|---|---|
| 2,426,695 | 9/1947 | Kremiller | 60/567 |
| 3,976,023 | 8/1976 | Noguchi et al. | 114/144 E |

FOREIGN PATENT DOCUMENTS

| | | | |
|---|---|---|---|
| 1,945,443 | 3/1971 | Fed. Rep. of Germany | 114/144 R |

*Primary Examiner*—Stephen G. Kunin

*Attorney, Agent, or Firm*—R. S. Visk; R. W. McIntire, Jr.

[57] ABSTRACT

Apparatus for remotely controlling direction and speed of marine engines, including at least two operator controllers located remotely from each other in respective areas of the vessel, electric-hydraulic apparatus operably interposed between the two controllers and responsive to control signals transmitted from and corresponding to the direction and speed setting of one of the controllers for synchronously effecting corresponding setting of the other controller at all times.

7 Claims, 3 Drawing Figures

PRIOR ART

REMOTE CONTROL APPARATUS FOR MARINE ENGINES

BACKGROUND OF THE INVENTION

A conventional remote control apparatus for marine engines is illustrated diagrammaatically in FIG. 1 of the drawings. In FIG. 1, reference numeral 1 indicates a bridge area of a vessel, numeral 2 indicates a main control room area, a numeral 3 indicates an engine room.

The apparatus, as shown in FIG. 1, comprises an auxiliary controller 4 located on the bridge 1 and having an operator's handle 5 which may be operated to a selected position for setting the direction and speed of an engine 6. Controller 4 then emits, for example, an electrical control signal which is transmitted via a conductor 7 to a relay circuit 8 in control room 2. From relay circuit 8, the electrical control signal is transmitted via a conductor 9 to an electric-hydraulic transducer 10 which converts the electric signal to a hydraulic control signal.

The hydraulic signal from transducer 10 is transmitted via a pipe 11 to a control circuit 12 whence a further control signal is transmitted via a pipe 13 to an engine control device 14 for effecting starting or stopping, direction of rotation, or speed of engine 6, depending upon the characteristic of the control signal received by said engine control device.

In some instances, the control signal from controller 4 may be a hydraulic signal, in which case said hydraulic signal is transmitted directly to control circuit 12.

A main controller 15 is located in control room 2. When main controller 15 is used for controlling operation of engine 6, the control signal, which normally is a hydraulic signal, emitted from said main controller, is transmitted via a pipe 16 to control circuit 12, which operates in the fashion above described to effect the desired engine operation. Should the main controller 15 be of the type emitting an electrical signal, such signal would first be transmitted to transducer 10 for conversion to a hydraulic signal which would then follow the course as above described.

With the use of the aforementioned conventional remote control apparatus, at such time that control of engine 6 is being effected by auxiliary controller 4 and it is desired to switch such control to the main controller 15, said main controller must first be set to a position corresponding to that of the auxiliary controller or at the engine direction and speed prevailing at the time the switch-over is made. Thus, such transition or switch-over may be accomplished smoothly and without possible damage to the apparatus, which could occur if the two controllers are not synchronized. Since the conventional remote control apparatus above described does not provide for automatic synchronization of the main controller 15 with the auxiliary controller 8, some means such as dials or voice communication must be used for apprising the operator in control room 2 of the prevailing engine conditions at the time he sets said main controller to correspond thereto. This procedure, of course, necessitates some loss of time and may also result in error due to misreading of the dials or misunderstanding of the voice communication.

SUMMARY OF THE INVENTION

The object of the present invention, therefore, is to provide remote control apparatus for marine engines including a plurality of controllers such as an auxiliary controller located on the bridge of the vessel and a main controller in the main control room, whereby transitional control or switch-over of control from the auxiliary controller to the main controller can be effected without delay or error by automatically effecting movement or setting of said main controller to a position corresponding to that at which the auxiliary controller is set at the time the switch-over is made.

Briefly, the invention comprises remote control apparatus for marine engines, said apparatus including an operator's auxiliary controller located in one area of the vessel, such as on the bridge, and a main controller located in the main control room, and characterized by interconnecting electrichydraulic operating means responsive to the setting of the auxiliary controller for automatically causing the main controller to assume a corresponding setting whereby switching of engine control, that is, direction and speed, from the auxiliary controller to the main controller may be accomplished, at any given amount, without delay and error.

DESCRIPTION AND OPERATION - FIGS. 2 & 3

Figure 1:
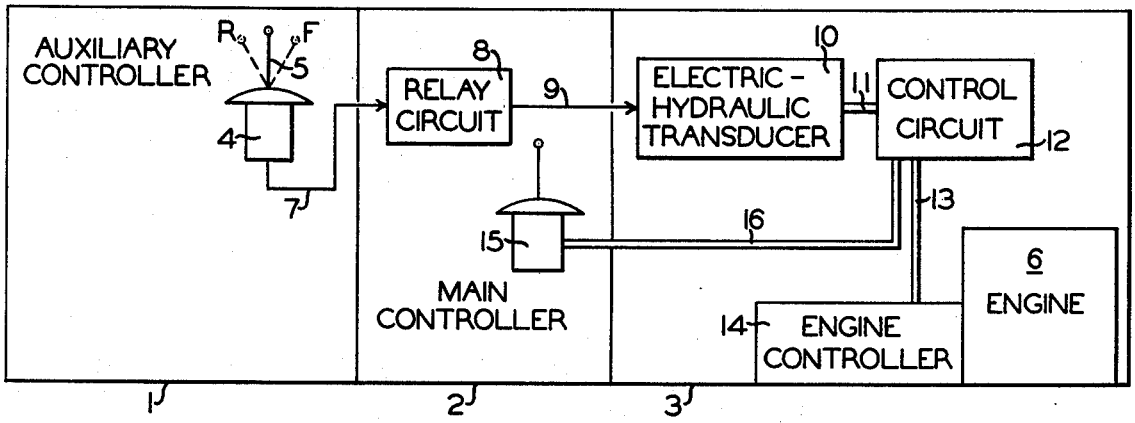
FIG. 1 is a diagrammatic view showing a remote control apparatus for marine engines and designated PRIOR ART.
Figure 2:
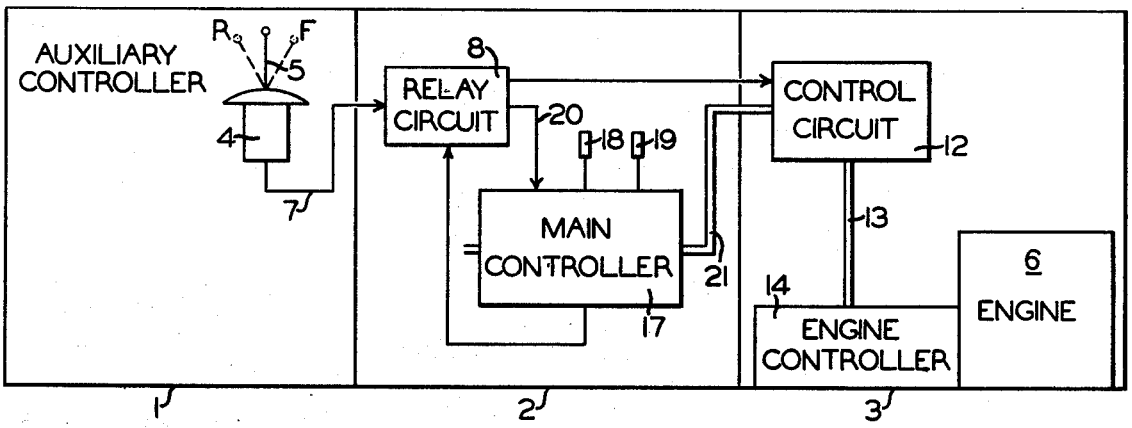
FIG. 2 is a diagrammatic view of a remote control apparatus according to the invention.
Figure 3:
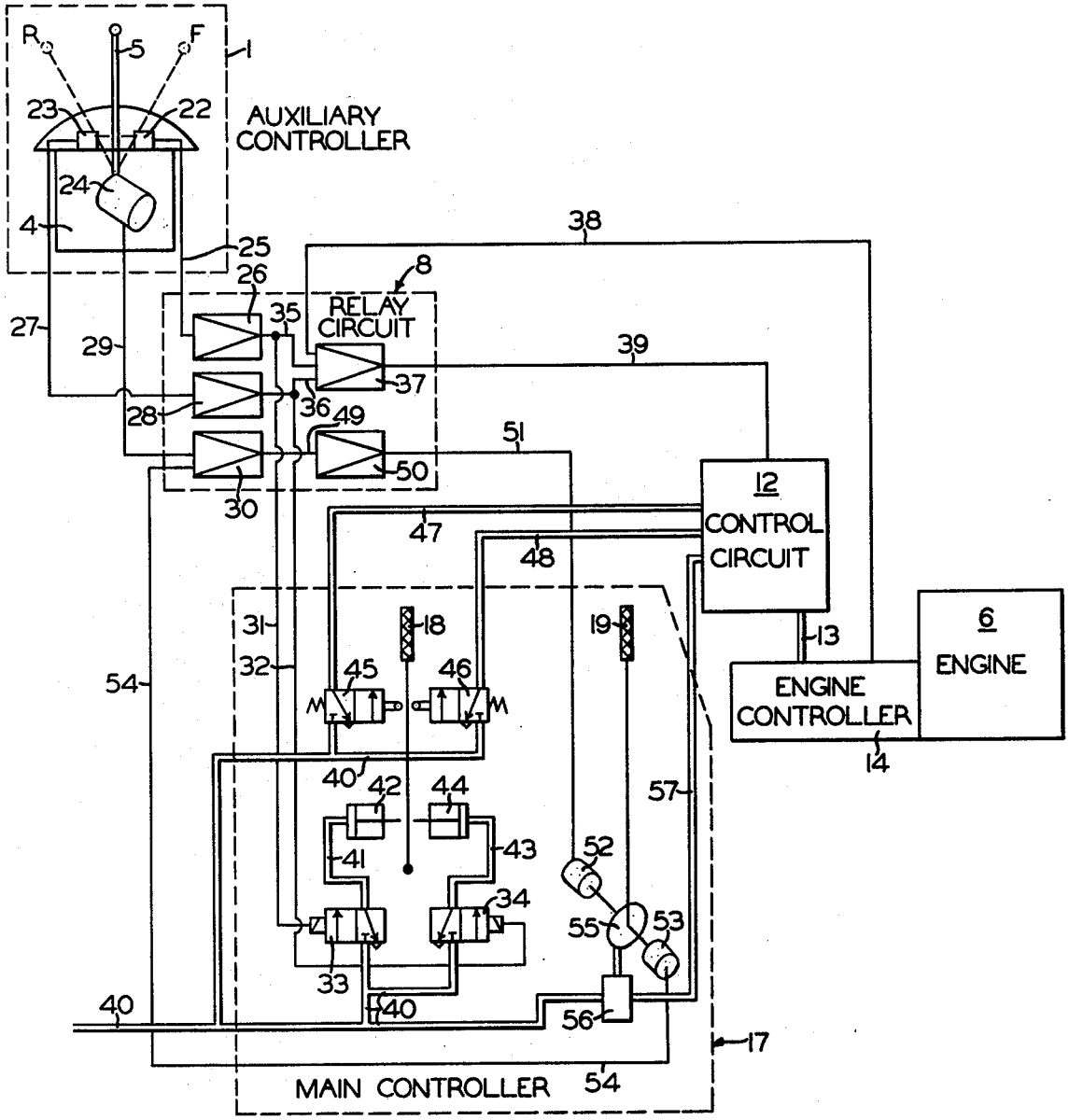
FIG. 3 is a diagrammatic view, in greater detail, of the remote control apparatus shown in FIG. 2.

FIGS. 2 and 3 illustrate a novel remote control apparatus for marine engines in accordance with the invention, and in describing said apparatus, similar reference numerals will be applied to similar components already shown in FIG. 1.

As shown in simplified form in FIG. 2 of the drawings, the novel remote control apparatus comprises the auxiliary controller 4 in bridge area 1, relay circuit 8 in the main control room 2, and a dual-handle main controller 17 in said main control room. Main controller 17 is provided with a direction-setting handle 18 and a speed-setting handle 19.

When auxiliary controller 4 is operated to a selected position, an electrical control signal emitted therefrom is transmitted via conductor 7 to relay circuit 8 thence via a conductor 20 to the dual-handle main controller 17, where the electrical signal is converted to a hydraulic signal which is transmitted via a pipe 21 to control circuit 12. As in the apparatus shown in FIG. 1, when control circuit 12 receives the hydraulic signal from main controller 17, appropriate direction and speed signals are transmitted via pipe 13 to engine controller 14 which actuates engine 6 in the direction and speed called for by the operator.

In accordance with the invention, when main controller 17 receives direction and speed control signals from relay circuit 8, handles 18 and 19 assume, in a manner to be more fully described hereinafter, respective positions corresponding to the direction and speed at which auxiliary controller 4 was set by the operator. Hence, main controller 17 necessarily always produces a control signal in agreement with that produced by auxiliary controller 4 to, therefore, at any time enable a switch-over from said auxiliary controller to said main controller without any delay or error.

FIG. 3 shows in greater detail the several circuits of the novel remote control apparatus shown in FIG. 2.

As shown in FIG. 3, auxiliary controller 4 is provided with the operating handle 5, forward and reverse switches 22 and 23, respectively, and a detector device 24 for detecting the amount of angular movement of displacement of the operating handle. Depending upon which direction handle 5 is moved, an output forward signal from forward switch 22 is transmitted via a conductor 25 to a forward signal amplifier 26 of relay circuit 8, or, on the other hand, an output reverse signal from reverse switch 23 is transmitted via a conductor 27 to a reverse signal amplifier 28 of the relay circuit.

An output speed signal from detector 24 is transmitted via a conductor 29 to a speed comparator 30 in relay circuit 8. An output forward or reverse direction signal from reverse or forward amplifiers 26 and 28 is fed via conductors 31 or 32 to a forward solenoid valve 33 or a reverse solenoid valve 34, respectively, of main controller 17, while, at the same time, both signals from said forward and reverse amplifiers are fed via branch portions 35 and 36 of said conductors, respectively, to a direction comparator 37. The prevailing direction setting of engine 6, at any given time, is also fed back to comparator 37 via a conductor 38 from engine controller 14. An output direction signal, after comparator 37 has determined such direction, is fed via a conductor 39 to control circuit 12 and via engine controller 18 to set a direction switch (not shown) of engine 6 in the direction called for. No further actuation of engine 6 occurs until a "start" signal is received, in a manner to be hereinafter disclosed, by engine controller 14.

If forward solenoid valve 33 is energized, said valve operates in conventional manner to effect supply of hydraulic fluid pressure from a source pipe 40 via a pipe 41 to a forward positioning device 42, whereas energization of reverse solenoid valve 34 effects supply of hydraulic fluid pressure from said source via a pipe 43 to a reverse positioning device 44. Thus, depending on which of the positioning devices 42 or 44 is actuated, handle 18 is correspondingly operated to a forward or reverse position. Moreover, depending upon the position of handle 18, one or the other of a forward signal valve 45 or a reverse signal valve 46 is operated to an open position for effecting transmittal of a hydraulic signal from source pipe 40 via a pipe 47 or a pipe 48, respectively, to control circuit 12, said pipes 47 and 48 being represented by the single pipe 21 in FIG. 2.

An output speed signal from comparator 30 is fed via a conductor 49 to a speed signal amplifier 50, the output speed signal of which is transmitted via a conductor 51 to a servo motor 52 of main controller 17. Servo motor 52 sets the position of speed handle 19, which also has associated therewith a detector 53 for sending back, via a conductor 54, an output signal reflecting the extent of operation of said servo motor to comparator 30, where said output signal of detector 53 and the output signal from detector 24 are compared to insure an accurate positioning of handle 19 to correspond to the speed position of handle 5 of auxiliary controller 4.

At the same time that handle 19 is positioned by servo motor 52, a cam 55 is accordingly rotated to a corresponding position for causing a hydraulic pressure control valve 56 to be opened for effecting transmission, via a pipe 57, of pressurized hydraulic fluid to control circuit 12 at a pressure proportional to the angular displacement of said cam and, therefore, the extent to which said control valve is opened.

In summarizing the operation of the remote control apparatus shown in FIGS. 2 and 3, when lever 5 of auxiliary controller 4 is moved to a forward position, indicated by a broken line F in all Figures of the drawings, switch 22 provides a forward direction signal which, via forward amplifier 26, is fed to forward solenoid valve 33, which, in turn, causes pressurized hydraulic fluid to be supplied to forward positioning device 42.

Positioning device 42 moves handle 18 to a forward direction position in which position forward signal valve 45 is actuated to send a forward hydraulic signal via pipe 47 to control circuit 12. This brings about operation of engine controller 14 to confirm the setting of the direction switch (not shown) of engine 6 in a forward direction setting, as was previously effected by comparator 37 and hereinbefore noted. When switching of engine 6 to the forward-rotating direction is so confirmed, a "switching-completed" signal is fed back, via conductor 38, to comparator 37 of relay circuit 8, which, in turn, transmits, via conductor 39, control circuit 12, and engine controller 14, a "start" signal to engine 6. Subsequent to starting of engine 6 and upon attainment thereof of a predetermined speed of rotation, control circuit 12 places pipe 57 in communicating condition with engine controller 14, whereupon a "start-completed" signal is transmitted via conductor 38 to comparator 37 to thus suspend any further output from said comparator.

When starting of engine 6 in the forward direction has been completed, and with pipe 57 communicated with engine controller 14, the speed of said engine is determined by the pressure of hydraulic fluid supplied to the engine controller, said pressure, as hereinbefore noted, being determined by the extent to which hydraulic pressure control valve 56 has been opened by cam 55.

Thus, as above described, after the direction and speed of engine 6 and the respective positions of handles 18 and 19 of main controller 17 have been synchronously adjusted to the direction and speed determined by the position of handle 5 of auxiliary controller 4, control of said direction and speed of said engine may be taken over by said main controller, if desired, without error and loss of time.

If handle 5 of auxiliary controller 4 is shifted to a reverse direction, indicated by a broken line R in all Figures of the drawings, reverse switch 23 is actuated, and the operation proceeds in a manner similar to that above described in connection with the forward direction operation.

Having now described the invention, what we claim as new and desire to secure by Letters Patent, is:

1. In remote control apparatus for controlling direction and speed of a marine engine, synchronizing means for synchronizing operation of at least two operator controllers located remotely from each other, said synchronizing means comprising:

(a) an operator auxiliary controller selectively operable to a direction position for setting the direction of engine rotation, and to one of a plurality of speed positions for setting the rate of engine rotation by emitting respective electrical direction and speed control signals, said auxiliary controller including respective forward and reverse switch devices, one of which is actuated for producing said direction control signal according to the direction position to which the auxiliary controller is operated, and including a detector device for producing said speed control signal according to the speed position to which the auxiliary controller is operated;

(b) an operator main controller selectively operable, independently of said auxiliary operator controller, to a direction position for setting the direction of engine rotation, and to one of a plurality of speed positions for setting the rate of engine rotation by emitting respective direction and speed control signals;

(c) relay circuit means including respective forward and reverse amplifiers, one or the other of which receives the direction control signal from one or the other of the respective switch devices, depending upon the direction position of said auxiliary controller, and transmits such direction control signal to said main controller, and including a speed comparator for comparing the speed control signal produced by said detector device with the speed control signal emitted by said main controller, (d) said main controller including positioning means responsive to said direction and speed control signals for effecting operation of said main controller to direction and speed positions corresponding to those of the auxiliary controller;

(e) engine controller means operable responsively to direction and speed control signals for effecting operation of the engine according to said control signals; and (f) control circuit means operably interposed between said main controller and said engine controller for transmitting said control signals from said main controller to said engine controller.

2. Remote control apparatus, as set forth in claim 1, wherein said relay circuit means includes a direction comparator device for determining the appropriate direction control signal transmitted to said control circuit means, according to the direction position of said auxiliary controller, and transmitting said appropriate direction control signal to said control circuit means for setting engine direction correspondingly.

3. Remote control apparatus, as set forth in claim 1, wherein said main controller includes conversion means for converting said electrical direction and speed control signals to hydraulic signals which are transmitted to said control circuit means.

4. Remote control apparatus, as set forth in claim 3, wherein said conversion means includes a servo motor responsive to said speed control signal transmitted thereto by said relay circuit means for setting said main controller at a speed position corresponding to that of the auxiliary controller.

5. Remote control apparatus, as set forth in claim 4, wherein said relay circuit means includes a speed signal amplifier interposed serially between said speed comparator and said servo motor.

6. Remote control apparatus, as set forth in claim 5, wherein said conversion means includes:

(a) a source of hydraulic fluid pressure;

(b) a hydraulic control valve device interposed between said source and said control circuit means and being operable to an open position for causing said hydraulic speed control signal to be supplied from said source to said control circuit means at a pressure according to the extent to which said valve device is opened; and (c) a cam member connected to and operable by said servo motor for operating said hydraulic valve control device according to the extent of operation of said servo motor compatibly with the electrical speed control signal received thereby.

7. Remote control apparatus, as set forth in claim 6, wherein said conversion means includes:

(a) a direction setting handle operable to either a forward or reverse position;

(b) respective forward and reverse solenoid valve devices connected to said auxiliary controller and to said source of hydraulic fluid pressure;

(c) respective forward and reverse positioning devices disposed on opposite sides of said handle and connected to said solenoid valve devices, said positioning devices being operable responsively to hydraulic fluid pressure supplied thereto via the solenoid valve devices, upon energization of the latter responsively to the respective control signal from said auxiliary controller, for setting the position of said handle either in a forward or reverse position according to the direction signal from the auxiliary controller;

(d) respective forward and reverse signal valve devices interposed between said source of hydraulic fluid pressure and said control circuit means, (e) one or the other of said signal valve devices being operable by said handle, depending upon the position thereof, for effecting transmission of a direction control signal to said control circuit means accordingly.

* * * * *